US010636403B2

(12) United States Patent
Clark

(10) Patent No.: US 10,636,403 B2
(45) Date of Patent: Apr. 28, 2020

(54) ELECTRONIC SENSOR DEVICE FOR DETECTING THE VIBRATION RELATED TO AN AMPLIFICATION SYSTEM WITHIN STRINGED MUSICAL INSTRUMENTS

(71) Applicants: Bradley Roy Clark, Guangzhou, Guangdong (CN); Richard Wellenreiter, Hamilton (CA)

(72) Inventor: Bradley Roy Clark, Guangzhou (CN)

( * ) Notice: Subject to any disclaimer, the term of this patent is extended or adjusted under 35 U.S.C. 154(b) by 0 days.

(21) Appl. No.: 16/406,112

(22) Filed: May 8, 2019

(65) Prior Publication Data

US 2019/0348017 A1 Nov. 14, 2019

(30) Foreign Application Priority Data

May 10, 2018 (CN) ..... 2018 1 0442835

(51) Int. Cl.
*G10H 1/18* (2006.01)
*G10H 3/14* (2006.01)
*G10H 3/18* (2006.01)

(52) U.S. Cl.
CPC ..... *G10H 3/143* (2013.01); *G10H 3/18* (2013.01); *G10H 2220/525* (2013.01)

(58) Field of Classification Search
CPC .... G10H 3/185; G10H 3/18; G10H 2220/471; G10H 2220/525; G10H 2220/535; G10H 2220/485; G10H 2220/495; G10H 3/181; G10H 2220/465; G10D 3/04
See application file for complete search history.

(56) References Cited

U.S. PATENT DOCUMENTS 5,539,147 A * 7/1996 Hoshino ..... G10H 3/185 84/723
6,166,309 A * 12/2000 Hoshino ..... G10D 3/04 84/298
9,183,815 B2 * 11/2015 Finkle ..... G10D 3/00
2010/0307324 A1 * 12/2010 Takabayashi ..... G10H 3/143 84/731
2013/0019736 A1 * 1/2013 Finkle ..... G10D 3/00 84/313

* cited by examiner

*Primary Examiner* — Marlon T Fletcher

(57) ABSTRACT

An electronic sensor device for detecting the vibration related to an amplification system within stringed musical instruments. The described structure is detachably mounted below the saddle. It comprises several central piezoelectric elements, several metal capped poles, and each metal capped pole consists of an integrally formed pole and cap, from top to bottom.

The top end of the pole extends through a matching positioning hole into the saddle slot and touches the bottom of the saddle. The bottom end of the cap accurately captures the top of the central piezoelectric element, and the top ring of the cap is closely pressed up to the bridge plate.

The invention provides an electronic sensor device for detecting the vibration related to an amplification system within stringed musical instruments, which is easy to install and is easily uninstalled. By applying mass on the non-sensing side of piezoelectric element assembly, the electro-acoustic amplification performance of the instruments is greatly enhanced, as it is firmly coupled to the stringed instruments, therefore improving the sensing efficiency, in providing better output and tone that is closer to the original acoustic.

12 Claims, 5 Drawing Sheets

ELECTRONIC SENSOR DEVICE FOR DETECTING THE VIBRATION RELATED TO AN AMPLIFICATION SYSTEM WITHIN STRINGED MUSICAL INSTRUMENTS

The present application claims priority from regularly filed Chinese invention patent application number 201810442835.0 titled "An Electronic Sensor Device for Detecting the Vibration Related to an Amplification System Within Stringed Musical Instruments" filed on May 10, 2018 by applicant Guangzhou Brad Clark Music Co., Ltd invented by Bradley Roy Clark.

TECHNICAL FIELD

An electronic sensor device for detecting the vibration related to an amplification system within stringed musical instruments, in particular to an electronic sensor device for vibration sensing and the amplification of stringed instruments.

BACKGROUND TECHNOLOGY

An electronic sensor device for detecting the vibration related to an amplification system within stringed musical instruments. The described stringed instrument has a bridge on its face panel or soundboard, and on the back of the soundboard a bridge reinforcement plate at an equivalent position. The bridge comprises string pin holes and a saddle slot. The strings pass through the string pin holes from outside and are affixed to the bridge reinforcement plate. Strings are normally attached to the string pins.

To efficiently transfer vibrations to the surrounding atmosphere, to create sound, the body of an acoustic guitar is comprised of relatively thin sections of, usually timber or other thin substrates. However such thin substrates will not only sympathetically vibrate with the strings, but also the electronically amplified sound of the instrument, that is, sound arising from speakers in the vicinity of instrument, so forming ongoing vibrations or a loop within the instrument's thin sections and strings and then the amplification system: This 'loop' is commonly referred as 'feedback'.

The saddle is the terminating point of the guitar's strings. The position of the saddle determines the length of the guitar's strings, or the "musical scale length". Because the saddle is located at the end of the strings, it can effectively pick up the vibration of the strings, as the strings vibrate the resonant cavity of the guitar from that point. In order to avoid "feedback", the pickup device is usually installed under the saddle and usually placed in the saddle slot between the saddle and the bridge.

There are Three Main Existing Methods for Sound Pickup Technology:

1) Hard strip: six small piezoelectric ceramic elements or pieces: each responsible for picking up vibration of a string. The six ceramic pieces are glued in a metal strip or shell. Layers of adhesive are necessary to manufacture the device, and they compromise efficient coupling, and because the piezoelectric ceramic elements are small, electrical output is low;

2) Soft piezo strips: Soft strips are wrapped in plastic or other pliable materials, or else are comprised of 'piezoelectric-plastic'. The greater the number of layers the higher the electrical output and therefore sensitivity: However soft plastic material is less effective in sound transmission than solids, and so the efficiency of the transducer is compromised, as both strip type pickups rely on the transverse force of strings in applying downward force to the saddle, so that the saddle couples the pickup device to the guitar with a downward force.

3) Six large piezoelectric ceramic rods equidistant apart, fixed up under the bridge on an aluminum bar base, comprising screws and nuts on both sides. However the third type of pickup system can only be installed if an instrument that has been manufactured specifically for the installation of the said device: special holes or apertures must have been drilled or routed or otherwise created in the instrument's soundboard and bridge during manufacture.

This system cannot therefore be easily installed in existing instruments. The current invention solves this problem: so that installation is able to be performed with relative ease on existing instruments, which have not been specially manufactured so that the piezoelectric elements sensing device describe in 3 are able to be installed.

The Shortcomings of the Existing Technology are as Follows:

1. In existing technologies, both the hard piezoelectric strips and the soft piezoelectric strips can only be coupled or clamped by the downward pressure of the saddle, which is applied after the strings are tuned or tightened. This leads to poor coupling and feedback. Furthermore, because the devices are not well coupled, they are relatively insensitive to the surrounding structure's resonance. Further, the non-sensing side of 'strip type piezoelectric sensors', comprise very little mass and therefore are relatively inefficient. The reason for this, is that due to the light weight of such devices, there is insufficient difference between the sensing side and the non-sensing side which, to be efficient, should tend to inertia, so that the created analogue signal is a measure of the difference between one side and the other. Further there is insufficient space within the saddle slot to house piezoelectric elements of substantial and more ideal mass and therefore electrical output.

2. It is known that the sound waves decreases when passing through softer materials or when there is a gap between devices. Sound travels more efficiently through solid materials than it does through soft or elastic materials, or where there are gaps. And so when the soft strip is mounted on an acoustic guitar, the transmission efficiency of the soft strip is not as high as that of harder solid materials. In existing technology, piezoelectric elements are assembled by means of adhesive, usually within a metallic U channel or strip. Relatively soft or elastic adhesive layers compromises the carrying of sound waves.

3. Within the first two existing pickup devices referred to, piezoelectric elements must be installed within the saddle slot under the saddle. The space within the saddle slot under the saddle limits the volume of the piezoelectric material that can be used. And so where the output of the electric signal is proportional to the volume of the piezoelectric material, so the output of the electric signal is also relatively limited. Further in that prior art, the commonly used hard and soft strip type piezoelectric pickups efficiency is dependent upon the flatness of the base of the saddle slot. If the bottom of the saddle slot is uneven, the output of each of the six strings is likely to be dissimilar, compromising the performance of the device: as some strings are less sensed than others.

SUMMARY OF THE INVENTION

In order to overcome the shortcomings of the prior art stated above, this invention aims to provide an electronic sensing device for vibration sensing and amplification system of stringed instruments, which is easy to install and uninstall. And by applying mass on the non-sensing side of piezoelectric elements, the amplified performance of the instruments is greatly enhanced.

The device can be firmly coupled to the stringed instruments so as to effectively improve the pickup's efficiency and sound quality, therefore producing a more accurate representation of the instrument's acoustic performance. It also enables the loading of larger, therefore more powerful piezoelectric components.

The present concept is an electronic sensor device for detecting the vibration related to an amplification system within stringed musical instruments which include a saddle mounted into a saddle slot of a bridge which is mounted onto the outside of the sound board; one end of the strings of the musical instrument are stretched over the saddle and connected to string pins located in string positioning holes; on the inside of the sound board, is a bridge reinforcing plate, such that bridge reinforcing plate is immediately under the bridge, separated by the sound board, a pickup assembly is detachably mounted on the inside of the sound board and partially extends upwardly to a bottom of the saddle, and the sensor device is characterized by:

a fixed and mounted piezoelectric element for each string, which is configured to convert string vibrations into electrical signals, each piezoelectric element is connected to a metal capped rod, wherein from top to bottom each integrally formed metal capped rod consists of a rod portion with a top, and a cap portion with a top annular shoulder, and a bottom piezo receiving cavity, for each piezo-electric element the piezo receiving cavity is adapted to receive in abutting fashion the top of the piezoelectric element, the top of the rod portion is well coupled in abutting relationship with the bottom of the saddle below the saddle slot 95, and the top annular shoulder of the cap portion is located in well coupled abutting relationship with the bridge reinforcing plate, such that induced vibration from a string is transmitted through the sound board onto the bridge reinforcing plate and onto the top annular shoulder of the metal capped rod, and vibration from a string is also transmitted through the saddle to the top of the metal capped rod wherein the metal capped rod transmits and carries vibrations from the saddle and also from the sound board via the bridge reinforcing plate to the piezo electric element. The bridge, sound board and bridge reinforcing plate act as an acoustic well coupled integral unit.

Preferably the electronic sensor device for detecting the vibration related to an amplification system within stringed musical instruments is also characterized by: a pickup base fixing assembly positioned under the bridge reinforcing plate, the pick-up base fixing assembly includes a pick up base which is connected to the non-sensing side of the piezoelectric elements, and detachably rigidly fastened to the bridge, the pickup base is adapted to provide a preselected amount of mass to the pickup assembly, wherein the upper surface of the pickup base presses against the bottom ends of the piezoelectric elements, so that each metal capped rod is equally pressed up in intimate contact with the saddle and the bridge reinforcing plate, thereby creating an well coupled acoustic structure.

Preferably the electronic sensor device for detecting the vibration related to an amplification system within stringed musical instruments described in claim 2 is also characterized by:

a number of auxiliary piezoelectric elements positioned in parallel and closely to the metal capped rods, to sense the vibration proximate the centre of the soundboard, the auxiliary piezoelectric elements are distributed on the upper surface of the pickup base on either sides of the centrally located piezoelectric elements, and the top of each auxiliary piezoelectric elements is fitted with a metal caps which abut against the bridge reinforcing plate, for transmitting the vibration to the piezo electric element.

Preferably the electronic sensor device for detecting the vibration related to an amplification system within stringed musical instruments described in Claim 1 is also characterized by adjustable contact area between the top annular shoulder and the bridge reinforcing plate by selecting the diameter of the top annular shoulder, and the diameter of the positioning hole is less than or equal to the width of the saddle slot.

Preferably the electronic sensor device for detecting the vibration related to an amplification system within stringed musical instruments is further characterized in that the diameter of the positioning hole does not much exceed 3 mm, or else does not much exceed the width of the saddle slot, and the described installation nuts and bolts are 3 mm bolts and nuts, or of a similar size.

Preferably the electronic sensor device for detecting the vibration related to an amplification system within stringed musical instruments described in Claim 4 is also characterized in that the pick-up base is installed with nuts and bolts which pass through the bridge reinforcing plate, the soundboard and bridge at either ends of the saddle slot and the top of the bolts are "T" shaped or inverted "L" shaped, to nest within the saddle slot and to avoid contact with the saddle.

The Technical Issues Solved by the Invention are as Follows

The Described Device can be Detachably Mounted Below the Saddle, and it Comprises:

To faithfully reproduce and amplify the sound generated by strings of a stringed instrument such as a guitar. The present concept uses a number of centrally located piezoelectric elements to convert the received vibration into an electrical signal.

A number of metal capped rods positioned on the top of the piezoelectric elements so transmitting the induced vibration to the fixed central piezoelectric elements.

The metal capped rod consists of an integrally formed rod and cap from top to bottom. The top end of the pole extends through a matching positioning hole into the saddle slot, and rises above the bottom of the slot so that it comes in contact with the base of the saddle.

The base end of the described cap accurately receives, captures and fits the top of the central piezoelectric elements in piston and cylinder fashion, and they are clamped together, so that they are well coupled, enhancing the efficiency of the carrying of sound waves. The top ring of the cap is closely pressed up under the bridge plate so that the rod aspect can pass through 3 mm diameter or other suitable sized drilled holes, suitably positioned by means of a 'drilling jig', which is also an aspect of the invention.

As a further improvement within invention, the described sensing device also comprises a pickup base assembly which provides mass on the non-sensing side of the centrally located piezoelectric elements and simultaneously fixes the entire structure under the bridge, inside the stringed instrument.

The upper surface of the described pickup base presses up to and clamps in place the bottom of the centrally located piezoelectric elements, and also comprises pickup circuitry. The device is installed by means of nuts and bolts through the bridge reinforcing plate, the soundboard and through either ends of saddle slot in order to exert a greater mass on the non-sensing side of the central piezoelectric element, that is, the side that does not directly contact the stringed instrument, the pickup base is comprised of metal or alloy materials which is, relative to wood, hard and dense.

The described sensor structure is installed inside the musical instrument, and so is not confined by the narrow space between the saddle slot and the saddle. Therefore, this invention effectively overcomes the space limitation of installing large piezoelectric elements, and has more electric signal output than the existing devices referred to 1 & 2, which are confined to the saddle slot.

The pickup base is preferably aluminum, brass or other high-density machined or extruded hard metal with flat surfaces; so that the pickup base does not easily deform, and so that the flat surfaces effectively avoids the uneven clamping of the piezoelectric elements, that is, avoiding the problem of unbalanced sensing of each string; Furthermore, the material that comprises the pickup's base is also conductive to vibration and contributes to the tone to a certain extent.

As a further improvement of this invention, the described sensor device also comprises a number of auxiliary piezoelectric elements for sensing the vibration of the center of the soundboard; the described auxiliary piezoelectric elements are distributed on the surface of the pickup base on both sides of the central piezoelectric element, and a metal cap for transmitting the vibration of the panel is seamlessly fitted on the top, and the top of the metal cap is tightly pressed up to the bridge reinforcing plate. Preferably, the diameter of the positioning hole is less than or equal to the width of the saddle slot. It is further preferable that the diameter of the positioning holes does not exceed 3 mm, and the installation bolt and nut are matched 3 mm bolts and nuts. In this invention, the installation bolt is locked from inside of the guitar, which does not affect the structure or appearance of a guitar and is also easily removed.

Preferably, the nut of the installation bolt is "T" shaped or inverted "L" shape to suit the installation in the saddle slot, so that once the installation is completed, the entire assembly will be invisible, as it is covered by the saddle. Preferably, the pickup base also comprises an electrical radio frequency shielding layer.

Preferably, the described contact area between the top of the cap ring and the bridge reinforcing plate is adjustable by adjusting its contact area; so the balance of the amount of soundboard vibration picked up by the cap, and the amount of string vibration picked up from the saddle by the top of the rod, is able to be altered. The described stringed instrument is a guitar, and the number of metal capped rods and central piezoelectric elements are 6. The number of auxiliary piezoelectric elements is 2 to 8.

This invention also includes a matching drilling jig. The bottom of the described drilling jig has a positioning block for fitment into the saddle slot. The drilling jig comprises 8 holes: 2 to create the holes to suit the clamping nuts and bolts, and 6 holes to suit the fitment of the 6 capped rods. The drilling jig is used to accurately drill the holes so to facilitate easy installation of the pickup device.

Compared with the Prior Art, the Beneficial Effects of this Invention are as Follows:

In this invention, the use of metal capped rods and the pickup base comprises sufficient mass and is firmly coupled to the musical instrument by nuts and bolts, which not only effectively overcomes the space limitation for piezoelectric elements installed within the saddle slot, i.e. larger piezoelectric elements comprising high electrical output that are able to be loaded on the base, but also greater mass on the non-sensing side of the piezoelectric elements enhances the piezoelectric effect, generating larger electrical signals.

The pickup base is structural stiff, does not easily deform, reducing feedback, the possibility of extraneous vibration and improves the pickup's efficiency; the flat surface effectively avoids possible uneven contact problems related to the strip piezoelectric system; the device is screw clamped by means of nuts and bolts, and is able to be installed on a finished guitar, so that installation is not confined to guitars that have been manufactured to suit the installation of 'large piezoelectric elements', which is the case in prior art 3.

Notably the top of the metal capped rods pick up the vibration of the strings from under the saddle, carrying the sound waves to the piezoelectric elements, while the top annular shoulder of the cap portion presses, against the bridge reinforcing plate, and picks up the vibration of the soundboard, providing improved reproduction of the instrument's acoustic performance.

If there are auxiliary piezoelectric elements, they are coupled via the bridge reinforcing plate to the soundboard, further sensing the vibration of the soundboard of the musical instrument, again enhancing the device's reproduction of the instrument's acoustic performance.

The device can be easily installed assisted by the provided drilling jig, and without compromising the structure or the appearance of the instrument, and the pickup device can be easily uninstalled, without being structurally or aesthetically detrimental to the instrument.

SPECIFIC IMPLEMENTATION METHODS

Figure 1:
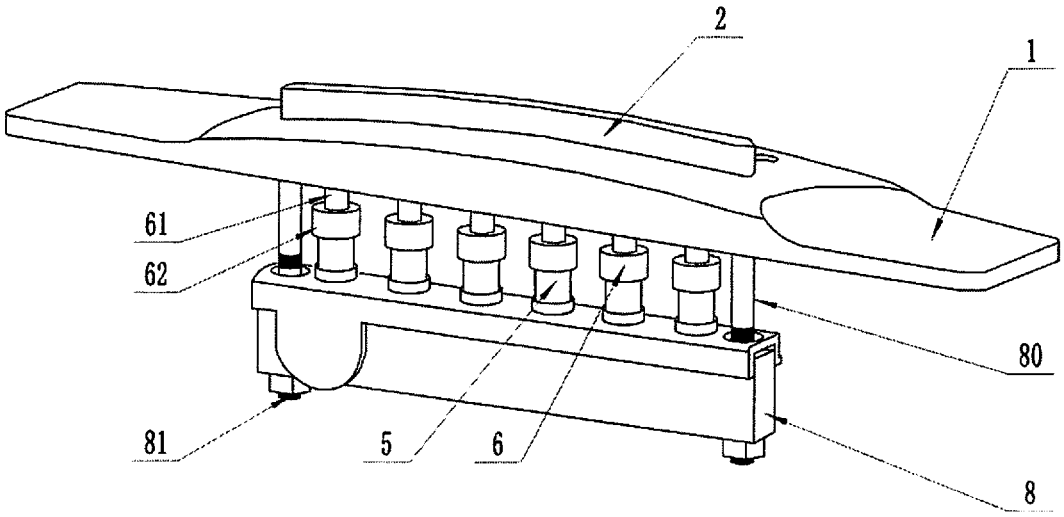
FIG. 1 is a schematic diagram of the assembly structure of the invention.
Figure 2:
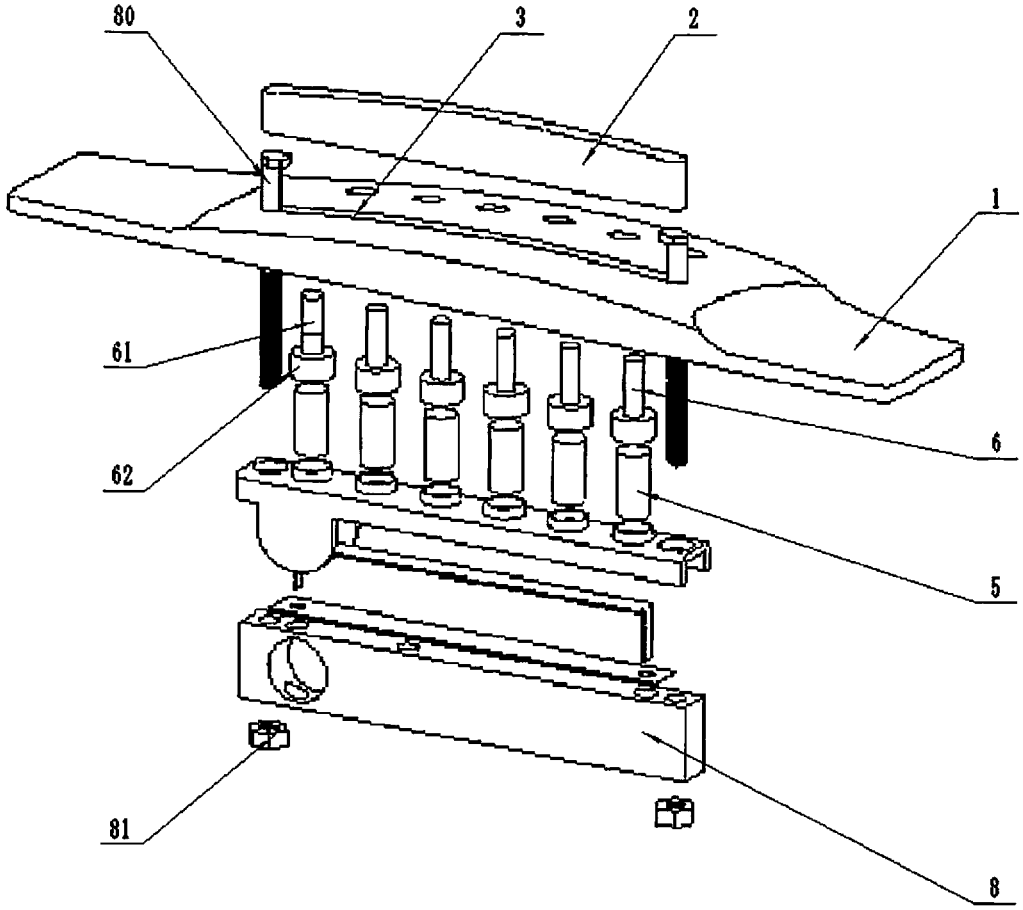
FIG. 2 is a schematic diagram of the exploded view of structure of the invention.
Figure 3:
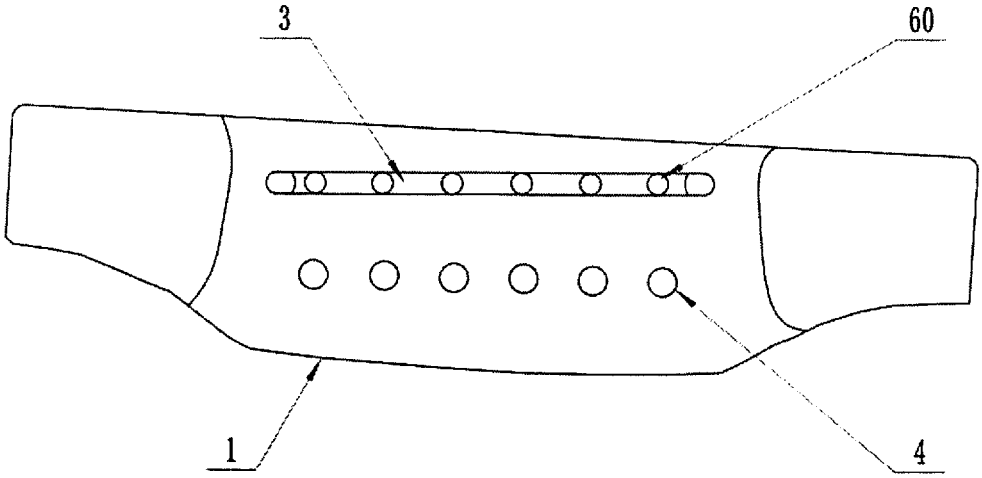
FIG. 3 is a top view of the installation of the invention in the bridge.
Figure 4:
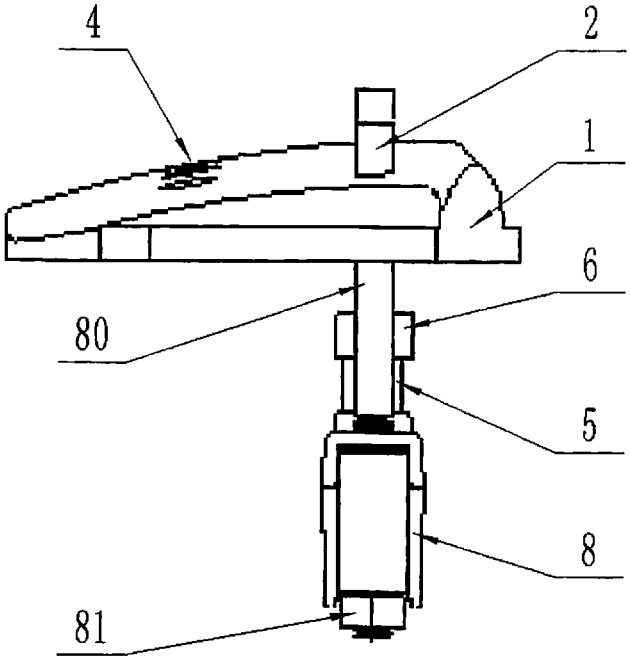
FIG. 4 is a side view of the assembly structure of the invention.
Figure 5:
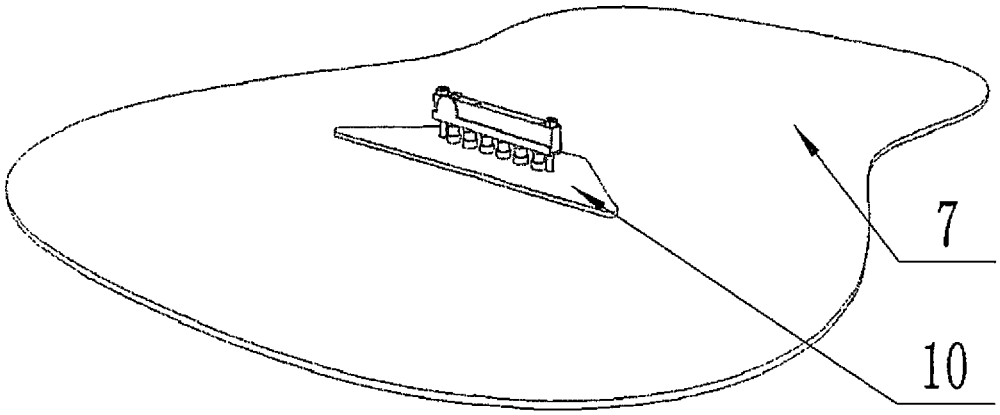
FIG. 5 is a schematic diagram of the structure of this invention mounted on the underside of the soundboard.
Figure 6:
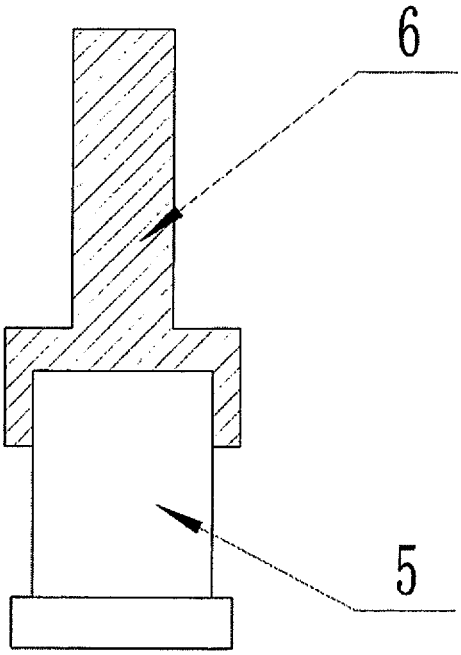
FIG. 6 is a schematic diagram of the assembled view of the metal capped rods and the central piezoelectric elements of this invention mounted together.

This invention is further illustrated in conjunction with the illustration of the drawings and the implementation case.

Case 1: Refer to FIGS. 1 to 6. An electronic sensor device for detecting the vibration related to an amplification system within stringed musical instruments. The described stringed instrument is a guitar.

The front of the soundboard 7 of the stringed instrument is equipped with a bridge 1, and the back of the soundboard usually comprises a bridge reinforcing plate 10. The described bridge is equipped with string positioning holes 4 and a saddle slot 3 for installing the saddle 2. The strings pass through the string pin holes from outside and are pinned or affixed to the bridge reinforcement plate.

Steel string guitar strings produce approx 70 kg of tension at standard pitch or tuning, and nylon string guitar strings usually produce 40 kg of tension. In addition, there are also bracings on the back of the face panel, protecting the face from cracking and deforming under the tension of the strings.

The described electric pickup device is detachably mounted below the saddle 2, it comprises:

Several centrally located piezoelectric elements, 5, to convert vibration into electrical signals.

A number of metal capped rods 6 for mounting on the tops of the centrally located piezoelectric elements and transmitting the induced vibration to the fixed centrally located piezoelectric elements, in which the number of the metal capped rods and the central piezoelectric elements are six.

The described metal capped rod 6 from top to bottom consists of an integrally formed rod portion 61 and a cap portion 62. The top 54 of the rod portion 61 extends through a matching positioning hole 60 to the saddle slot 3, and touches the bottom of the saddle 2.

Figure 8:
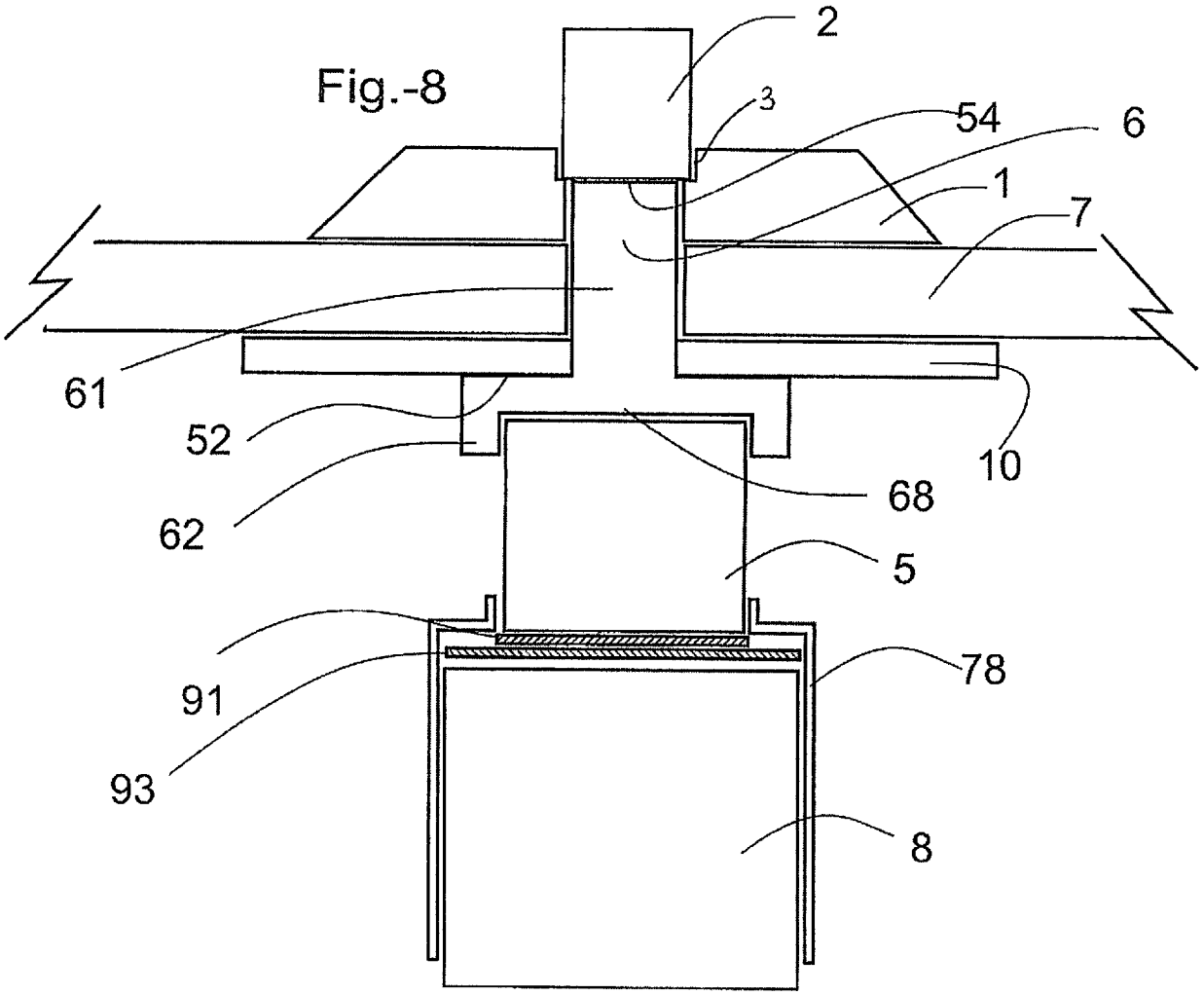
FIG. 8 is a schematic cross sectional view of the pick-up assembly of one piezo electric element and includes a saddle, metal capped rods, bridge, sound board, bridge reinforcing plate, piezo electric element, electrical contact, insulator strip, piezo receiving cavity, saddle slot and pick up base.

Referring to FIG. 8 which is a schematic cross sectional view of a portion of the pick-up assembly taken through one piezo-electric element and includes saddle 2, metal capped rod 6, bridge 1, sound board 7, bridge reinforcing plate 10, piezo electric element 5, and pick up base 8. It further depicts top 54 of rod portion 61 also referred to as rod, top annular shoulder 52 of cap portion 62 also referred to as cap, electrical contact 91 which is normally positive, insulator strip 93, piezo receiving cavity 68, saddle slot 95 and electromagnetic shielding 78.

The bottom of the cap 62 accurately captures the top of the central piezoelectric element, and the top annular shoulder 52 of the cap 62 is pressed up against the bridge reinforcing plate. The vibration of the soundboard is picked up by the caps through the bridge reinforcing plate. The bridge reinforcing plate is an important aspect of the soundboard. The sensing and reproduction of the vibration at the soundboard's central contributes to quality and realism of the amplified performance of the stringed musical instrument. Therefore, this invention provides a more realistic reproduction of the performance of an acoustic guitar, as the metal capped rods are well coupled to the piezoelectric elements and the soundboard producing a well coupled acoustic structure. A well coupled acoustic structure is one in which the elements of the structure are in intimate contact to promote transmission and carrying of acoustic vibrations. The described rod aspect passes through a positioning hole comprising a diameter of 3 mm; or a similar suitable size.

The soundboard of a stringed instrument vibrates sympathetically with the strings when they are played or plucked, and therefore the soundboard is an acoustic amplifier.

A pickup device senses the soundboard and the guitar body's resonance, creating a proportionate electrical signal, which is then amplified.

In this invention, the metal capped rods are firmly coupled with the piezoelectric elements as well as to the soundboard, so that they sense the string vibration under saddle and vibration at the soundboard's centre then transmit it to the coupled piezoelectric elements, providing a more realistic reproduction of the original performance of the guitar.

The described device also comprises a pickup base 8 for the central piezoelectric elements to sit on. The purpose of this base is for applying mass on the non-sensing side of the central piezoelectric elements and for fixing the device under the bridge within the stringed instrument; the upper surface of the pickup base is clamped by means of nuts and bolts at either end of the structure: to the base comprising piezoelectric elements, and device also comprises an internal, and so shielded circuit. It is installed with bolts 80 and nuts 81 through the bridge reinforcing plate, the soundboard, and the saddle slot on either ends of the saddle.

In order to apply a greater mass on the non-sensing side of the piezoelectric elements, that is, the side that does not directly contact the stringed instrument, the pickup base is made of relatively dense and stiff metal or alloy. The piezoelectric elements themselves are of a greater mass and volume than strip type piezo element sensors, which means the aspect that does not directly contact the stringed instrument comprises greater mass, the piezoelectric effect is enhanced, that is, that it produces greater electrical output than the referred to prior art. The piezoelectric elements are also well coupled to the stringed instrument, which reduces the possibility of feedback, extraneous vibration and improves efficiency.

The described pickup circuit is used to connect the piezoelectric elements, outputting the sensed signals from the piezoelectric elements by means of an electrical lead. The described electrical lead enables the device to be connected to an electrical preamplifier. In the current permutation the invention only has one output lead connecting it to an electrical preamplifier.

The diameter of the currently described positioning hole 60 is less than or equal to the width of the saddle slot. The width of the standard prior art saddle slot in the West is 3.2 mm, but in China are generally 3 mm, 2.8 mm and 2.5 mm. In this case, according to the different width of the saddle slot of stringed instruments, the diameter of the positioning hole 60 is 1 mm to 3.2 mm.

The diameter of the currently described positioning hole is not more than 3 mm, and the installation bolts and nuts are equivalent 3 mm bolts and nuts. This invention can be clamped or well coupled under the soundboard. The installation bolts are tightened from inside the instrument, which affects neither the structure nor the appearance of the guitar, and is far superior to the existing technology in which the installation requisites negatively affect the structure of the guitar and its appearance.

The heads of the described bolts for installation is T-shaped or inverted L-shaped, to suit the width of the saddle slot, so that once the installation is completed, the entire assembly is invisible, being covered by the saddle. Compared with the third method of the prior art, this invention achieves more solid coupling, because in the third method of the prior art, the bolts lock the screw holes at the two ends of the aluminum base from the two ends of the saddle slot downwards, and relies on the tapping of the threads into the aluminum base for the tightness; while the bolts with T-type or L-type screw heads are locked at the two ends of the saddle slot.

In this invention there are two nuts under the screw holes on both ends of the aluminum base to secure the structure, which greatly improves the efficiency of coupling, enhancing sound transmission so increasing the sensitivity and reproduction of the instrument's acoustic performance.

The described pickup base 8 is extruded or machined aluminum or brass comprising a flat surface thus avoiding the common problem of uneven contact related to the strip piezoelectric systems in the prior art. Simultaneously, the extruded or machined aluminum or brass section is a metal material which is relatively hard so comprising sufficient mass to optimize the device's performance.

The described pickup base comprises an electrical radio frequency shielding layer. That is, the pickup base comprises a solid aluminum bar and a plastic shell coated with shielding paint on the outer surface. The outer surface of the plastic shell as well as the outer surface of the piezoelectric elements form the assembly, and are sprayed with copper or other shielding paint to form the electrical shielding layer.

The contact area between the top annular shoulder 52 of the described cap 62 and the back of the sound board is adjustable, and by adjusting the contact area, adjustable is the balance of the amount of soundboard vibration picked up by the cap, and the amount of string vibration picked up from the saddle by the top of the rod.

Compared with the Third Method of Prior Art, the Invention has Three Differences:

1) The third method of prior art requires pre machined holes or routings of the instrument's bridge, the soundboard and the bridge reinforcing plate, compromising the instrument's original structure: That is, several approx. 5 mm diameter holes to accommodate the piezoelectric cylindrical prisms, which will affect the manner in which the device is coupled as well as the structure of the instrument. In other words the prior art devices do not use metal capped rods 6. By contrast, this invention requires the drilling of small holes to accommodate the metallic capped rods comprising a diameter of less than 3 mm;

2) The third method of prior art requires the holes pre-drilled or milled in the process of guitar making, in anticipating installation of the pickup systems, and it requires the bridge reinforcing plate to comprise a pre-routed aperture to allow the piezoelectric cylindrical prisms assembly to pass through the bridge reinforcing plate 10. As otherwise the assembly will not couple with the saddle's base in which case it would be ineffective.

3) Whereas in the invention, the length of piezoelectric cylindrical prisms is effectively increased by the use of caps and integral rods. As well, in the invention the vibration of the wood, besides the vibration of the strings, can also be sensed, improving the device's performance.

Figure 7:
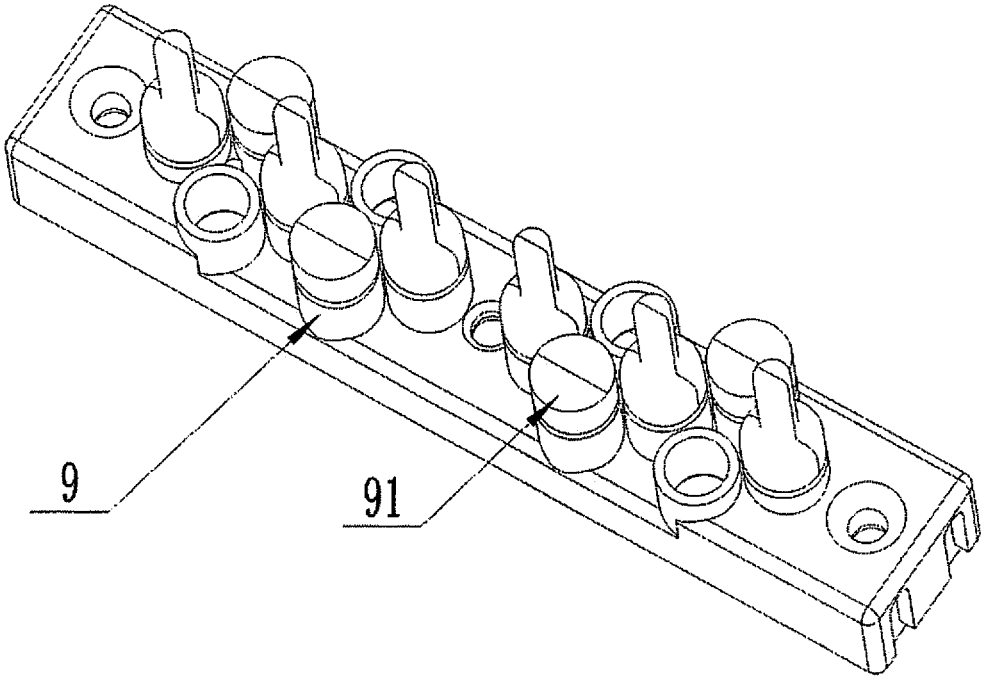
FIG. 7 is a schematic diagram of case 2 of this invention.

Case 2: Refer to FIG. 7. The difference between case 2 and case 1 is that besides six central piezoelectric elements, the sensing structure also includes two to eight auxiliary piezoelectric elements 9, which are used to sense the vibration of the center of the soundboard. The number and location of the auxiliary piezoelectric elements depends on the practical application requirements. In this case, the conductive structure includes four. The auxiliary piezoelectric elements are distributed on the upper surface of the pickup base on either sides of the central piezoelectric element, and metal caps 91 for transmitting face panel vibration are fitted on top of the piezo seamlessly. The top of the metal cap is pressed up against the bridge reinforcing plate.

The described auxiliary piezoelectric elements and the metal cap installed at the top of the piezoelectric element have space limitation. When implemented, the auxiliary piezoelectric elements should be as close as possible to the centrally located piezoelectric elements. The position of the auxiliary piezoelectric element should not exceed the bridge reinforcing plate, for reason that amplitude at the bridge is at its greatest.

The described auxiliary piezoelectric elements are connected with the pickup circuit, and a second output electrical lead for outputting sensed signals of the several auxiliary piezoelectric elements is also connected to an external electrical preamplifier. In this scenario, the pickup circuit includes two outputs: one electric lead for one set of piezoelectric elements and a second lead for the second set of piezoelectric elements. The first output lead connects six centrally located piezoelectric elements. The second output lead connects the auxiliary piezoelectric elements. The first output circuit and the second output circuit are connected to a preamplifier. In practice, the first output circuit and the second output circuit can be integrated on the same circuit board or two separate circuit boards; as one of the embodiments, the second output circuit module is a long strip circuit board.

In the second permutation, the invention comprises two electrical output leads connected to a preamplifier, so that both electrical output signals are sent to the same preamplifier, where they are summed to form a single output.

Both the centrally located piezoelectric elements and the auxiliary piezoelectric elements are ceramic elements which generate an electrical signal when they are vibrated.

In summary, technicians within the said field of sensing electrical technology, having read the documentations described herein, would be able to create the same or similar systems which would be protected by the scope of the invention described herein.

I claim:

1. An electronic sensor device for detecting the vibration related to an amplification system within stringed musical instruments of the type which include a saddle mounted into a saddle slot of a bridge which is mounted onto the outside of a sound board; one end of a string of a musical instrument is stretched over a saddle; on the inside of a sound board, is a bridge reinforcing plate, such that a bridge reinforcing plate is immediately under the bridge separated by the sound board; a pickup assembly is detachably mounted on the inside of a sound board and partially extends upwardly to a bottom of a saddle, the sensor device is comprised of;

a fixed and mounted piezoelectric element for each string, which is configured to convert string vibrations into electrical signals, each piezoelectric element is connected to a metal capped rod, wherein from top to bottom each integrally formed metal capped rod includes a rod portion with a top, and a cap portion with a top annular shoulder, and a bottom piezo receiving cavity, for each piezo-electric element the piezo receiving cavity is adapted to receive in abutting fashion the top of the piezoelectric element, and b) wherein the top of the rod portion is well coupled in abutting relationship with a bottom of the saddle below a saddle slot, and the top annular shoulder of the cap portion is located in well coupled abutting relationship with a bridge reinforcing plate, such that induced vibration from a string is transmitted through a sound board through the bridge reinforcing plate and onto the top annular shoulder of the metal capped rod, and vibration from a string is also transmitted through the saddle to the top of the metal capped rod wherein the metal capped rod transmits and carries vibrations from the saddle and also from the sound board via the bridge reinforcing plate to the piezo electric element.

2. The electronic sensor device claimed in claim 1 further includes; a pickup base fixing assembly positioned under the bridge reinforcing plate, the pick-up base fixing assembly includes a pick up base which is connected to the non-sensing side of the piezoelectric elements, and is detachably rigidly fastened to the bridge, the pickup base is adapted to provide a pre-selected amount of mass to the pickup assembly, wherein the upper surface of the pickup base presses against the bottom ends of the piezoelectric elements, so that each metal capped rod is equally pressed up in intimate well coupled contact with the saddle and the bridge reinforcing plate, thereby creating a well coupled acoustic structure.

3. The electronic sensor device claimed in claim 2 further includes;

a number of auxiliary piezoelectric elements positioned in parallel and closely to the metal capped rods, to sense the vibration proximate the centre of the soundboard, the auxiliary piezoelectric elements are distributed on the upper surface of the pickup base on either sides of the centrally located piezoelectric elements, and the top of each auxiliary piezoelectric element is fitted with a metal cap which abut against the bridge reinforcing plate, for operably transmitting a string vibration to the piezo electric element.

4. The electronic sensor device claimed in claim 1 further includes an adjustable contact area between the top annular shoulder and the bridge reinforcing plate by selecting the diameter of the top annular shoulder, wherein the diameter of the positioning hole is less than or equal to the width of the saddle slot.

5. The electronic sensor device claimed in claim 4 further wherein the diameter of the positioning hole does not exceed the width of the saddle slot, and the described installation nuts and bolts are dimensioned according to the size of the positioning hole.

6. The electronic sensor device claimed in claim 4 wherein the pick-up base is installed with nuts and bolts which pass through the bridge reinforcing plate, the soundboard and bridge at either ends of the saddle slot and the top of the bolts are "T" shaped or inverted "L" shaped, to nest within the saddle slot and to avoid contact with the saddle.

7. The electronic sensor device claimed in claim 4 further includes; wherein the pickup base surface which is connected to the non-sensing side of the piezoelectric element comprises a flat surface and the pick-up base is made of non-magnetic metal.

8. The electronic sensor device claimed in claim 4 further wherein the pickup base is also equipped with an electromagnetic shielding layer for shielding against radio frequency.

9. The electronic sensor device claimed in claim 1 further wherein the musical stringed instrument is a guitar, and the number of strings and therefore the number of metal capped rods and piezoelectric elements are selected between 4 and 12.

10. The electronic sensor device claimed in claim 3 wherein the number of auxiliary piezoelectric elements is selected from 2 to 12.

11. The electronic sensor device claimed in claim 3 wherein each piezo-electric element is cylindrical and the piezo receiving cavity includes a partially cylindrical portion adapted to receive, in piston and cylinder fashion, the piston shaped top of the piezoelectric element.

12. The electronic sensor device claimed in claim 2 wherein the pickup assembly includes an internal electrical contact and an insulator strip positioned between the bottom of the piezo electric element and the top of the pick-up base.

* * * * *